US010304469B2

(12) United States Patent
Boehm et al.

(10) Patent No.: US 10,304,469 B2
(45) Date of Patent: *May 28, 2019

(54) METHODS AND APPARATUS FOR ENCODING AND DECODING MULTI-CHANNEL HOA AUDIO SIGNALS

(71) Applicant: DOLBY LABORATORIES LICENSING CORPORATION, San Francisco, CA (US)

(72) Inventors: Johannes Boehm, Göttingen (DE); Sven Kordon, Wunstorf (DE); Alexander Krüger, Hannover (DE); Peter Jax, Hannover (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/685,252

(22) Filed: Aug. 24, 2017

(65) Prior Publication Data

US 2017/0352355 A1 Dec. 7, 2017

Related U.S. Application Data

(60) Division of application No. 15/275,699, filed on Sep. 26, 2016, now Pat. No. 9,837,087, which is a (Continued)

(30) Foreign Application Priority Data

Jul. 16, 2012 (EP) ..... 12305861

(51) Int. Cl.
*H04S 3/02* (2006.01)
*G10L 19/02* (2013.01)
(Continued)

(52) U.S. Cl.
CPC ..... *G10L 19/012* (2013.01); *G10L 19/008* (2013.01); *G10L 19/0212* (2013.01);
(Continued)

(58) Field of Classification Search
CPC ..... G10L 19/012; G10L 19/008; H04S 3/02
See application file for complete search history.

(56) References Cited

U.S. PATENT DOCUMENTS 8,103,006 B2 1/2012 McGrath
9,020,152 B2 4/2015 Swaminathan
(Continued)

FOREIGN PATENT DOCUMENTS

CN 101297353 10/2008
EP 2469741 6/2012
(Continued)

OTHER PUBLICATIONS

Abhayapala, Thushara D. "Generalized Framework for Spherical Microphone Arrays and Frequency Decomposition", Proc. IEEE International Conference on Acoustics, Speech and Signal Processing, Apr. 2008; pp. 5268-5271.
(Continued)

*Primary Examiner* — Brian L Albertalli

(57) ABSTRACT

A method for encoding multi-channel HOA audio signals for noise reduction comprises steps of decorrelating the channels using an inverse adaptive DSHT, the inverse adaptive DSHT comprising a rotation operation and an inverse DSHT, with the rotation operation rotating the spatial sampling grid of the iDSHT, perceptually encoding each of the decorrelated channels, encoding rotation information, the rotation information comprising parameters defining said rotation operation, and transmitting or storing the perceptually encoded audio channels and the encoded rotation information.

3 Claims, 7 Drawing Sheets

Related U.S. Application Data continuation of application No. 14/415,571, filed as application No. PCT/EP2013/065032 on Jul. 16, 2013, now Pat. No. 9,460,728.

(51) Int. Cl.
*G10L 19/008* (2013.01)
*G10L 19/012* (2013.01)
*G10L 19/038* (2013.01)

(52) U.S. Cl.
CPC ..... *G10L 19/038* (2013.01); *H04S 3/02* (2013.01); *H04S 2420/11* (2013.01)

(56) References Cited

U.S. PATENT DOCUMENTS

| | | | | |
|---|---|---|---|---|
| 9,100,768 | B2 | 8/2015 | Batke | |
| 9,241,216 | B2 | 1/2016 | Keiler | |
| 9,282,419 | B2 | 3/2016 | Sun | |
| 9,299,353 | B2 | 3/2016 | Sole | |
| 9,397,771 | B2 | 7/2016 | Jax | |
| 2004/0131196 | A1 | 7/2004 | Malham | |
| 2006/0045275 | A1 | 3/2006 | Daniel | |
| 2010/0198601 | A1 | 8/2010 | Mouhssine | |
| 2010/0305952 | A1 | 12/2010 | Mouhssine | |
| 2012/0014527 | A1 | 1/2012 | Furse | |
| 2012/0155653 | A1* | 6/2012 | Jax | G10L 19/008 381/22 |
| 2013/0010971 | A1* | 1/2013 | Batke | G10L 19/008 381/22 |
| 2013/0148812 | A1 | 6/2013 | Corteel | |
| 2014/0233762 | A1 | 8/2014 | Vilkamo | |

FOREIGN PATENT DOCUMENTS

| | | |
|---|---|---|
| JP | 2001-275197 | 10/2001 |
| JP | 2006-506918 | 2/2006 |
| JP | 2010-521909 | 6/2010 |

OTHER PUBLICATIONS

Daniel, J. et al "Further Investigations of High Order Ambisonics and Wavefield Synthesis for Holophonic Sound Imaging." AES Convention Paper 5788, presented at the 114th Convention, Mar. 22-25, 2003, Amsterdam, The Netherlands, pp. 1-18.

Driscoll, J. et al "Computing Fourier Transforms and Convolutions on the 2-sphere", Advances in Applied Mathematics, 15, pp. 202-250, 1994.

Fliege, Jorg, "A two-stage approach for computing cubature Formulae for the Sphere", Technical Report, Fachbereich Mathematik, Univerity Dortmund, 1999, pp. 1-31.

Fliege, Jorge "Integration nodes for the sphere" http://www.personal.soton.ac.uk/jf1w07/nodes/nodes.html; 1 page only.

Hardin, R.H. et al "McClaren's improved snub cube and other new spherical designs in three dimensions", Discrete and Computational Geometry, 15, pp. 429-331, 1996.

Hardin, R.H. et al. "Spherical Designs", http://www2.research.att.com/—njas/sphdesigns; 2013; pp. 1-3.

Hellerud, E. et al "Encoding higher order Ambisonics with AAC-AES124-HOA-AAC", 124th AES Convention, Amsterdam, May 2008; pp. 1-8.

Noisternig, M. et al "ESPRO 2.0-Implementation of a surrounding 350-loudspeaker array for sound field reproduction." Proceedings of the Audio Engineering Society UK Conference. 2012.

Rafaely, B. et al "Spatial aliasing in spherical microphone arrays" IEEE Transactions on Signal Processing, vol. 55, No. 2, Mar. 2007, pp. 1003-1010.

Rafaely, Boaz "Plane Wave Decomposition of the sound field on a Sphere by Spherical Convolution"; May 2003 (ISVR); pp. 1-40.

Rafaely, Boaz "Plane-wave decomposition of the sound field on a sphere by sperical convolution" J. Acoust. Soc. Am., 4(116), Oct. 2004, pp. 2149-2157.

Vaananen, Mauri, "Robustness issues in multi view audio coding", AES Convention paper 7623, presented at the 125th Convention, Oct. 2-5, 2008, San Francisco, CA, USA, pp. 1-8.

Williams, Earl G. "Fourier Acoustics", vol. 93 of Applied Mathematical Sciences. Academic Press, 1999; pp. 1-5.

Yang, D. et al "An Inter-Channel Redundancy Removal Approach for High-Quality Multichannel Audio Compression" AES 10th Convention, Los Angeles, Sep. 22-25, 2000, pp. 1-14.

Zotter, Franz, "Analysis and synthesis of sound-radiation with spherical arrays" Institute of Electronic Music and Acoustics, University of Music and Performing Arts, Austria, Sep. 2009, pp. 1-192.

* cited by examiner

METHODS AND APPARATUS FOR ENCODING AND DECODING MULTI-CHANNEL HOA AUDIO SIGNALS

CROSS-REFERENCE TO RELATED APPLICATION

This application is division of the U.S. patent application Ser. No. 15/275,699, filed Sep. 26, 2016, which is a continuation of the U.S. patent application Ser. No. 14/415,571, filed Jan. 16, 2015, now U.S. Pat. No. 9,460,728, which is a national application of the International Application No. PCT/EP2013/065032, filed Jul. 16, 2013, which claims priority to European Patent Application No. 12305861.2, filed Jul. 16, 2012, all of which are hereby incorporated by reference in their entirety.

FIELD OF THE INVENTION

This invention relates to a method and an apparatus for encoding multi-channel Higher Order Ambisonics audio signals for noise reduction, and to a method and an apparatus for decoding multi-channel Higher Order Ambisonics audio signals for noise reduction.

BACKGROUND

Higher Order Ambisonics (HOA) is a multi-channel sound field representation [4], and HOA signals are multi-channel audio signals. The playback of certain multi-channel audio signal representations, particularly HOA representations, on a particular loudspeaker set-up requires a special rendering, which usually consists of a matrixing operation. After decoding, the Ambisonics signals are "matrixed", i.e. mapped to new audio signals corresponding to actual spatial positions, e.g. of loudspeakers. Usually there is a high cross-correlation between the single channels.

A problem is that it is experienced that coding noise is increased after the matrixing operation. The reason appears to be unknown in the prior art. This effect also occurs when the HOA signals are transformed to the spatial domain, e.g. by a Discrete Spherical Harmonics Transform (DSHT), prior to compression with perceptual coders.

A usual method for the compression of Higher Order Ambisonics audio signal representations is to apply independent perceptual coders to the individual Ambisonics coeffcient channels [7]. In particular, the perceptual coders only consider coding noise masking effects which occur within each individual single-channel signals. However, such effects are typically non-linear. If matrixing such single-channels into new signals, noise unmasking is likely to occur. This effect also occurs when the Higher Order Ambisonics signals are transformed to the spatial domain by the Discrete Spherical Harmonics Transform prior to compression with perceptual coders [8].

The transmission or storage of such multi-channel audio signal representations usually demands for appropriate multi-channel compression techniques. Usually, a channel independent perceptual decoding is performed before finally matrixing the 1 decoded signals $\hat{\hat{x}}_i(l)$, i=1, . . . , I, into J new signals $\hat{\hat{y}}_j(l)$, j=1, . . . J. The term matrixing means adding or mixing the decoded signals $\hat{\hat{x}}_i(l)$ in a weighted manner. Arranging all signals $\hat{\hat{x}}_i(l)$, i=1, . . ., I, as well as all new signals $\hat{\hat{y}}_j(l)$, j=1, . . . , J in vectors according to $$\hat{\hat{x}}(l):=[\hat{\hat{x}}_1(l) \ldots \hat{\hat{x}}_I(l)]^T$$

$$\hat{\hat{y}}(l):=[\hat{\hat{y}}_1(l) \ldots \hat{\hat{y}}_J(l)]^T$$

the term "matrixing" origins from the fact that $\hat{\hat{y}}(l)$ is, mathematically, obtained from $\hat{\hat{x}}(l)$ through a matrix operation $$\hat{\hat{y}}(l)=A\hat{\hat{x}}(l)$$

where A denotes a mixing matrix composed of mixing weights. The terms "mixing" and "matrixing" are used synonymously herein. Mixing/matrixing is used for the purpose of rendering audio signals for any particular loudspeaker setups.

The particular individual loudspeaker set-up on which the matrix depends, and thus the maxtrix that is used for matrixing during the rendering, is usually not known at the perceptual coding stage.

SUMMARY OF THE INVENTION

The present invention provides an improvement to encoding and/or decoding multi-channel Higher Order Ambisonics audio signals so as to obtain noise reduction. In particular, the invention provides a way to suppress coding noise de-masking for 3D audio rate compression.

The invention describes technologies for an adaptive Discrete Spherical Harmonics Transform (aDSHT) that minimizes noise unmasking effects (which are unwanted). Further, it is described how the aDSHT can be integrated within a compressive coder architecture. The technology described is particularly advantageous at least for HOA signals. One advantage of the invention is that the amount of side information to be transmitted is reduced. In principle, only a rotation axis and a rotation angle need to be transmitted. The DSHT sampling grid can be indirectly signaled by the number of channels transmitted. This amount of side information is very small compared to other approaches like the Karhunen Loeve transform (KLT) where more than half of the correlation matrix needs to be transmitted.

According to one embodiment of the invention, a method for encoding multi-channel HOA audio signals for noise reduction comprises steps of decorrelating the channels using an inverse adaptive DSHT, the inverse adaptive DSHT comprising a rotation operation and an inverse DSHT (iDSHT), with the rotation operation rotating the spatial sampling grid of the iDSHT, perceptually encoding each of the decorrelated channels, encoding rotation information, the rotation information comprising parameters defining said rotation operation, and transmitting or storing the perceptually encoded audio channels and the encoded rotation information. The step of decorrelating the channels using an inverse adaptive DSHT is in principle a spatial encoding step.

According to one embodiment of the invention, a method for decoding coded multi-channel HOA audio signals with reduced noise comprises steps of receiving encoded multi-channel HOA audio signals and channel rotation information, decompressing the received data, wherein perceptual decoding is used, spatially decoding each channel using an adaptive DSHT (aDSHT), correlating the perceptually and spatially decoded channels, wherein a rotation of a spatial sampling grid of the aDSHT according to said rotation information is performed, and matrixing the correlated perceptually and spatially decoded channels, wherein reproducible audio signals mapped to loudspeaker positions are obtained.

In one aspect, a computer readable medium has executable instructions to cause a computer to perform a method for encoding comprising steps as disclosed above, or to perform a method for decoding comprising steps as disclosed above.

Advantageous embodiments of the invention are disclosed in the following description and the figures.

An aspect of the invention relates to a method for decoding Higher Order Ambisonics (HOA) audio signals. The method may include decompressing the HOA audio signals based on perceptual decoding to determine at least an HOA representation corresponding to the HOA audio signals. It may further include determining a rotated transform based on a rotation of a spherical sample grid; and determining a rotated HOA representation based on the rotated transform and the HOA representation.

An aspect of the invention may further relate to an apparatus including a decoder for decoding Higher Order Ambisonics (HOA) audio signals. The decoder may be configured to decompress the HOA audio signals based on perceptual decoding to determine HOA representations corresponding to the HOA audio signals; determine a rotated transform based on a rotation of a spherical sample grid; and determine a rotated HOA representation based on the rotated transform and the HOA representation.

The invention may further be directed to non-transitory computer readable mediums containing instructions that when executed by a processor perform the methods described above.

BRIEF DESCRIPTION OF THE DRAWINGS

Exemplary embodiments of the invention are described with reference to the accompanying drawings.

DETAILED DESCRIPTION OF THE INVENTION

Figure 1:
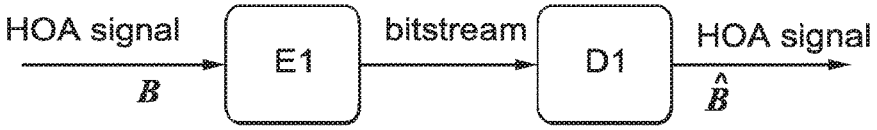
FIG. 1 PRIOR ART
FIG. 1 is a known encoder and decoder for rate compressing a block of M coefficients.
Figure 2:
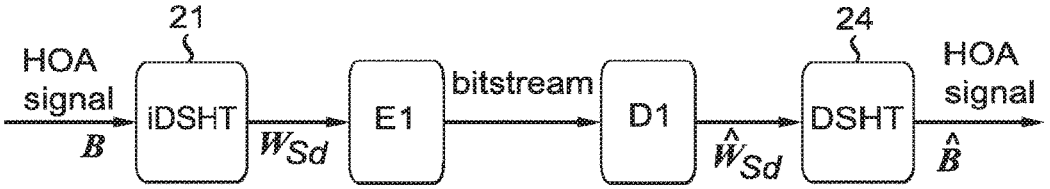
FIG. 2 PRIOR ART
FIG. 2 is a known encoder and decoder for transforming a HOA signal into the spatial domain using a conventional DSHT (Discrete Spherical Harmonics Transform) and conventional inverse DSHT.
Figure 3:
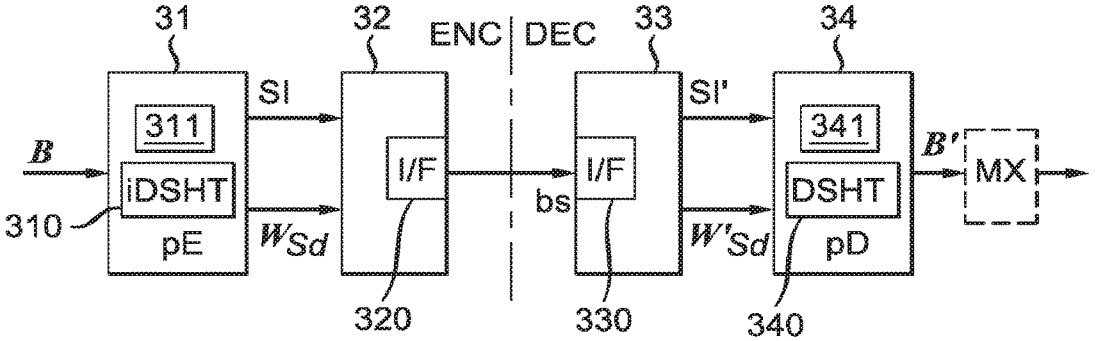
FIG. 3 is an encoder and decoder for transforming a HOA signal into the spatial domain using an adaptive DSHT and adaptive inverse DSHT.

FIG. 1 illustrates a known encoder and decoder for rate compressing a block of M coefficients. FIG. 2 further shows a known system where a HOA signal is transformed into the spatial domain using an inverse DSHT. The signal is subject to transformation using iDSHT 21, rate compression E1 /decompression D1, and re-transformed to the coefficient domain S24 using the DSHT 24. Different from that, FIG. 3 shows a system according to one embodiment of the present invention: The DSHT processing blocks of the known solution are replaced by processing blocks 31,34 that control an inverse adaptive DSHT and an adaptive DSHT, respectively. Side information SI is transmitted within the bitstream bs. The system comprises elements of an apparatus for encoding multi-channel HOA audio signals and elements of an apparatus for decoding multi-channel HOA audio signals.

In one embodiment, an apparatus ENC for encoding multi-channel HOA audio signals for noise reduction includes a decorrelator 31 for decorrelating the channels B using an inverse adaptive DSHT (iaDSHT), the inverse adaptive DSHT including a rotation operation unit 311 and an inverse DSHT (iDSHT) 310. The rotation operation unit rotates the spatial sampling grid of the iDSHT. The decorrelator 31 provides decorrelated channels $W_{sd}$ and side information SI that includes rotation information. Further, the apparatus includes a perceptual encoder 32 for perceptually encoding each of the decorrelated channels $W_{sd}$, and a side information encoder 321 for encoding rotation information. The rotation information comprises parameters defining said rotation operation. The perceptual encoder 32 provides perceptually encoded audio channels and the encoded rotation information, thus reducing the data rate. Finally, the apparatus for encoding comprises interface means 320 for creating a bitstream bs from the perceptually encoded audio channels and the encoded rotation information and for transmitting or storing the bitstream bs.

An apparatus DEC for decoding multi-channel HOA audio signals with reduced noise, includes interface means 330 for receiving encoded multi-channel HOA audio signals and channel rotation information, and a decompression module 33 for decompressing the received data, which includes a perceptual decoder for perceptually decoding each channel. The decompression module 33 provides recovered perceptually decoded channels $W'_{sd}$ and recovered side information SI'. Further, the apparatus for decoding includes a correlator 34 for correlating the perceptually decoded channels $W'_{sd}$ using an adaptive DSHT (aDSHT), wherein a DSHT and a rotation of a spatial sampling grid of the DSHT according to said rotation information are performed, and a mixer MX for matrixing the correlated perceptually decoded channels, wherein reproducible audio signals mapped to loudspeaker positions are obtained. At least the aDSHT can be performed in a DSHT unit 340 within the correlator 34. In one embodiment, the rotation of the spatial sampling grid is done in a grid rotation unit 341, which in principle re-calculates the original DSHT sampling points. In another embodiment, the rotation is performed within the DSHT unit 340.

In the following, a mathematical model that defines and describes unmasking is given. Assume a given discrete-time multichannel signal consisting of I channels $x_i(m)$, $i=1, \ldots, I$, where m denotes the time sample index. The individual signals may be real or complex valued. We consider a frame of M samples beginning at the time sample index $m_{START}+1$, in which the individual signals are assumed to be stationary. The corresponding samples are arranged within the matrix $X \in \mathbb{C}^{I \times M}$ according to $$X := [x(m_{START}+1), \ldots, x(m_{START}+M)] \tag{1}$$

where $$x(l) := [x_1(m), \ldots, x_I(m)]^T \tag{2}$$

with $(\cdot)^T$ denoting transposition. The corresponding empirical correlation matrix is given by $$\Sigma_X := XX^H, \tag{3}$$

where $(\cdot)^H$ denotes the joint complex conjugation and transposition.

Now assume that the multi-channel signal frame is coded, thereby introducing coding error noise at reconstruction. Thus the matrix of the reconstructed frame samples, which is denoted by $\hat{X}$, is composed of the true sample matrix X and an coding noise component E according to $$\hat{X}=X+E \tag{4}$$

with $$E:=[e(m_{START}+1), \ldots, e(m_{START}+L)] \tag{5}$$

and $$e(m):=[e_1(m), \ldots, e_I(m)]^T. \tag{6}$$

Since it is assumed that each channel has been coded independently, the coding noise signals $e_i(m)$ can be assumed to be independent of each other for i=1, . . . , I. Exploiting this property and the assumption, that the noise signals are zero-mean, the empirical correlation matrix of the noise signals is given by a diagonal matrix as $$\Sigma_E=\mathrm{diag}(\sigma_{e_1}^2, \ldots, \sigma_{e_I}^2) \tag{7}$$

Here, $\mathrm{diag}(\sigma_{e_1}^2, \ldots, \sigma_{e_I}^2)$ denotes a diagonal matrix with the empirical noise signal powers $$\sigma_{e_i}^2 = \frac{1}{M}\sum_{m=m_{START}+1}^{m_{START}+M} |e_i(m)|^2 \tag{8}$$

on its diagonal. A further essential assumption is that the coding is performed such that a predefined signal-to-noise ratio (SNR) is satisfied for each channel. Without loss of generality, we assume that the predefined SNR is equal for each channel, i.e., $$SNR_x = \frac{\sigma_{x_i}^2}{\sigma_{e_i}^2} \text{ for all } i = 1, \ldots, I \tag{9}$$

with $$\sigma_{x_i}^2 := \frac{1}{M}\sum_{m=m_{START}+1}^{m_{START}+M} |x_i(m)|^2. \tag{10}$$

From now on we consider the matrixing of the reconstructed signals into J new signals $y_j(m)$, j=1, . . . J. Without introducing any coding error the sample matrix of the matrixed signals may be expressed by $$Y=AX, \tag{11}$$

where $A\in\mathbb{C}^{J\times I}$ denotes the mixing matrix and where $$Y:=[y(m_{START}+1), \ldots, y(m_{START}+M)] \tag{12}$$

with $$y(m):=[y_1(m), \ldots, y_J(m)]^T. \tag{13}$$

However, due to coding noise the sample matrix of the matrixed signals is given by $$\hat{Y}:=Y+N \tag{14}$$

with N being the matrix containing the samples of the matrixed noise signals. It can be expressed as $$N=AE \tag{15}$$

$$N=[n(m_{START}+1) \ldots n(m_{START}+M)], \tag{16}$$

where $$n(m):=[n_1(m) \ldots n_J(m)]^T \tag{17}$$

is the vector of all matrixed noise signals at the time sample index m.

Exploiting equation (11), the empirical correlation matrix of the matrixed noise-free signals can be formulated as $$\Sigma_Y=A\Sigma_X A^H. \tag{18}$$

Thus, the empirical power of the j-th matrixed noise-free signal, which is the j-th element on the diagonal of $\Sigma_y$, may be written as $$\sigma_{y_j}^2=a_j^H\Sigma_X a_j \tag{19}$$

where $a_j$ is the j-th column of $A^H$ according to $$A^H=[a_1 \ldots, a_J]. \tag{20}$$

Similarly, with equation (15) the empirical correlation matrix of the matrixed noise signals can be written as $$\Sigma_N=A\Sigma_E A^H. \tag{21}$$

The empirical power of the j-th matrixed noise signal, which is the j-th element on the diagonal of $\Sigma_N$, is given by $$\sigma_{n_j}^2=a_j^H\Sigma_E a_j. \tag{22}$$

Consequently, the empirical SNR of the matrixed signals, which is defined by $$SNR_{y_j} := \frac{\sigma_{y_i}^2}{\sigma_{n_j}^2}, \tag{23}$$

can be reformulated using equations (19) and (22) as $$SNR_{y_j} = \frac{a_j^H \sum_X a_j}{a_j^H \sum_E a_j}. \tag{24}$$

By decomposing $\Sigma_X$ into its diagonal and non-diagonal component as $$\Sigma_X=\mathrm{diag}(\sigma_{x_1}^2, \ldots, \sigma_{x_I}^2)+\Sigma_{X,NG} \tag{25}$$

with $$\Sigma_{X,NG}:=\Sigma_X-\mathrm{diag}(\sigma_{x_1}^2, \ldots, \sigma_{x_I}^2), \tag{26}$$

and by exploiting the property $$\mathrm{diag}(\sigma_{x_1}^2, \ldots, \sigma_{x_I}^2)=SNR_x\cdot\mathrm{diag}(\sigma_{e_1}^2, \ldots, \sigma_{e_I}^2) \tag{27}$$

resulting from the assumptions (7) and (9) with a SNR constant over all channels ($SNR_x$), we finally obtain the desired expression for the empirical SNR of the matrixed signals:

$$SNR_{y_j} = \frac{a_j^H \mathrm{diag}(\sigma_{x_1}^2, , \sigma_{x_I}^2)a_j}{a_j^H \sum_E a_j} + \frac{a_j^H \sum_{X,NG} a_j}{a_j^H \sum_E a_j} \tag{28}$$

$$SNR_{y_j} = SNR_x\left(1 + \frac{a_j^H \sum_{X,NG} a_j}{a_j^H \mathrm{diag}(\sigma_{x_1}^2, \ldots, \sigma_{x_I}^2)a_j}\right). \tag{29}$$

From this expression it can be seen that this SNR is obtained from the predefined SNR, $SNR_x$, by the multiplication with a term, which is dependent on the diagonal and non-diagonal component of the signal correlation matrix $\Sigma_X$. In particular, the empirical SNR of the matrixed signals is equal to the predefined SNR if the signals $x_i(m)$ are uncorrelated to each other such that $\Sigma_{X,NG}$ becomes a zero matrix, i.e., $$SNR_{y_j}=SNR_x \text{ for all } j=1, \ldots, J, \text{ if } \Sigma_{X,NG}=0_{I\times I} \tag{30}$$

with $0_{I\times I}$ denoting a zero matrix with I rows and columns. That is, if the signals $x_i(m)$ are correlated, the empirical SNR of the matrixed signals may deviate from the predefined SNR. In the worst case, $SNR_{y_j}$ can be much lower than $SNR_x$. This phenomenon is called herein noise unmasking at matrixing.

The following section gives a brief introduction to Higher Order Ambisonics (HOA) and defines the signals to be processed (data rate compression).

Higher Order Ambisonics (HOA) is based on the description of a sound field within a compact area of interest, which is assumed to be free of sound sources. In that case the spatiotemporal behavior of the sound pressure p(t,x) at time t and position $x=[r,\theta,\phi]^T$ within the area of interest (in spherical coordinates) is physically fully determined by the homogeneous wave equation. It can be shown that the Fourier transform of the sound pressure with respect to time, i.e., $$P(\omega,x)=\mathcal{F}_t\{p(t,x)\} \tag{31}$$

where ω denotes the angular frequency (and $\mathcal{F}_t\{\ \}$ corresponds to $\int_{-\infty}^{\infty} p(t,x)e^{-\omega t}dt$), may be expanded into the series of Spherical Harmonics (SHs) according to, [10]:

$$P(kc_s, x) = \sum_{n=0}^{\infty} \sum_{m=-n}^{n} A_n^m(k) j_n(kr) Y_n^m(\theta, \phi) \tag{32}$$

In equation (32), $c_s$ denotes the speed of sound and $$k = \frac{\omega}{c_s}$$

the angular wave number. Further, $j_n(\cdot)$ indicate the spherical Bessel functions of the first kind and order n and $Y_n^m(\cdot)$ denote the Spherical Harmonics (SH) of order n and degree m. The complete information about the sound field is actually contained within the sound field coefficients $A_n^m(k)$.

It should be noted that the SHs are complex valued functions in general. However, by an appropriate linear combination of them, it is possible to obtain real valued functions and perform the expansion with respect to these functions.

Related to the pressure sound field description in equation (32), a source field can be defined as:

$$D(kc_s, \Omega) = \sum_{n=0}^{\infty} \sum_{m=-n}^{n} B_n^m(k) Y_n^m(\Omega), \tag{33}$$

with the source field or amplitude density [9] $D(k\ c_s,\Omega)$ depending on angular wave number and angular direction $\Omega=[\theta,\phi]^T$. A source field can consist of far-field/near-field, discrete/continuous sources [1]. The source field coefficients $B_n^m$ are related to the sound field coefficients $A_n^m$ by, [1]:

$$A_n^m = \begin{cases} 4\pi i^n B_n^m & \text{for the far field} \\ -ikh_n^{(2)}(kr_s)B_n^m & \text{for the near field}^1 \end{cases} \tag{34}$$

where $h_n^{(2)}$ is the spherical Hankel function of the second kind and $r_s$ is the source distance from the origin.

[1]We use positive frequencies and the spherical Hankel function of second kind $h_n^{(2)}$ for incoming waves (related to $e^{-ikr}$).

Signals in the HOA domain can be represented in frequency domain or in time domain as the inverse Fourier transform of the source field or sound field coefficients. The following description will assume the use of a time domain representation of source field coefficients:

$$b_n^m=i\mathcal{F}_t\{B_n^m\} \tag{35}$$

of a finite number: The infinite series in (33) is truncated at n=N. Truncation corresponds to a spatial bandwidth limitation. The number of coefficients (or HOA channels) is given by:

$$0_{3D}=(N+1)^2 \text{ for } 3D \tag{36}$$

or by $0_{2D}$=2N+1 for 2D only descriptions. The coefficients $b_n^m$ comprise the Audio information of one time sample m for later reproduction by loudspeakers. They can be stored or transmitted and are thus subject of data rate compression. A single time sample m of coefficients can be represented by vector b(m) with $O_{3D}$ elements:

$$b(m):=[b_0^0(m),b_1^{-1}(m),b_1^0(m),b_1^1(m),b_2^{-2}(m), \ldots ,b_N^N(m)]^T \tag{37}$$

and a block of M time samples by matrix B $$B:=[b(m_{START}+1),b(m_{START}+2), \ldots ,b(m_{START}+M)] \tag{38}$$

Two dimensional representations of sound fields can be derived by an expansion with circular harmonics. This is can be seen as a special case of the general description presented above using a fixed inclination of $\theta=\pi/2$, different weighting of coefficients and a reduced set to $0_{2D}$ coefficients (m=±n). Thus all of the following considerations also apply to 2D representations, the term sphere then needs to be substituted by the term circle.

The following describes a transform from HOA coefficient domain to a spatial, channel based, domain and vice versa. Equation (33) can be rewritten using time domain HOA coefficients for 1 discrete spatial sample positions $\Omega_l=[\theta_l, \phi_l]^T$ on the unit sphere:

$$d_{\Omega_l} := \sum_{n=0}^{N} \sum_{m=-n}^{n} b_n^m Y_n^m(\Omega_l), \tag{39}$$

Assuming $L_{sd}=(N+1)^2$ spherical sample positions $\Omega_l$, this can be rewritten in vector notation for a HOA data block B:

$$W=\Psi_i B, \tag{40}$$

with $W:=[w(m_{START}+1), w(m_{START}+2), \ldots , w(m_{START}+M)]$ and $$w(m) = [d_{\Omega_1}(m), \ldots , d_{\Omega_{L_{sd}}}(m)]^T$$

representing a single time-sample of a $L_{sd}$ multichannel signal, and matrix $\Psi_i=[y_1, \ldots , y_{L_{sd}}]^H$ with vectors $y_l=[Y_0^0(\Omega_l), Y_1^{-1}(\Omega_l), \ldots , Y_N^N(\Omega_l)]^T$. If the spherical sample positions are selected very regular, a matrix exists with $$\Psi_f\Psi_i=I, \tag{41}$$

where I is a $0_{3D}\times 0_{3D}$ identity matrix. Then the corresponding transformation to equation (40) can be defined by:

$$B=\Psi_f W. \tag{42}$$

Equation (42) transforms $L_{sd}$ spherical signals into the coefficient domain and can be rewritten as a forward transform:

$$B=DSHT\{W\}, \tag{43}$$

where DSHT{ } denotes the Discrete Spherical Harmonics Transform. The corresponding inverse transform, transforms $0_{3D}$ coefficient signals into the spatial domain to form $L_{sd}$ channel based signals and equation (40) becomes:

$$W=iDSHT\{B\}. \tag{44}$$

This definition of the Discrete Spherical Harmonics Transform is sufficient for the considerations regarding data rate compression of HOA data here because we start with coefficients B given and only the case B=DSHT{iDSHT{B}} is of interest. A more strict definition of the Discrete Spherical Harmonics Transform, is given within [2]. Suitable spherical sample positions for the DSHT and procedures to derive such positions can be reviewed in [3], [4], [6], [5]. Examples of sampling grids are shown in FIGS. 5A, 5B, 5C, and 5D.

Figure 5A:
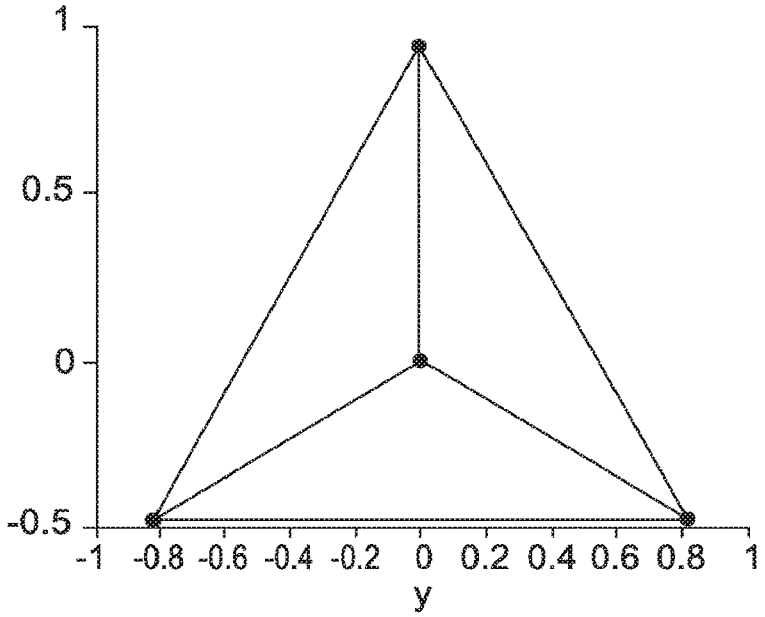
FIGS. 5A, 5B, 5C and 5D are examples of spherical sampling positions for a codebook used in encoder and decoder building blocks.
Figure 5B:
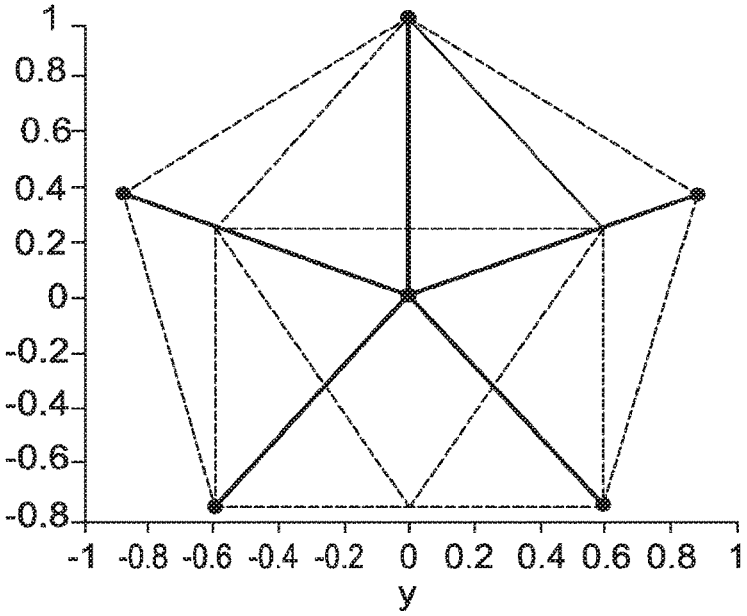
Figure 5C:
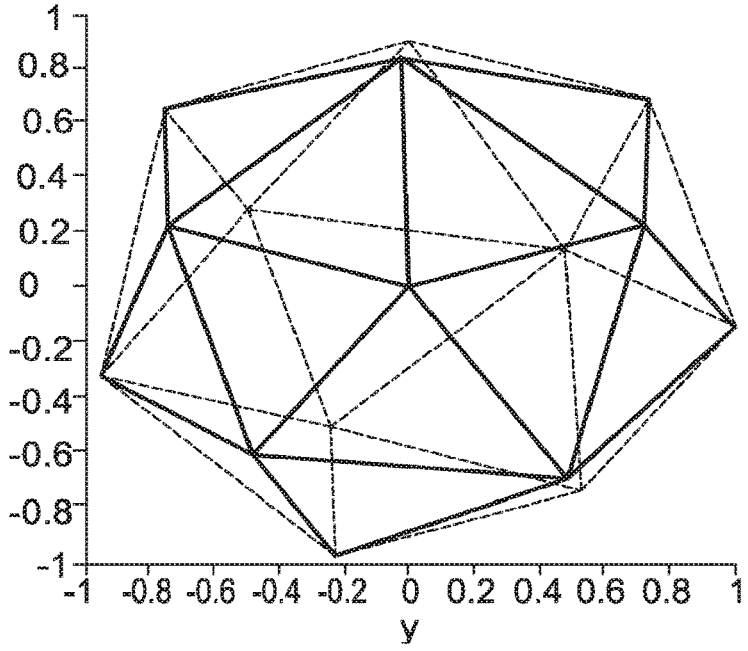
Figure 5D:
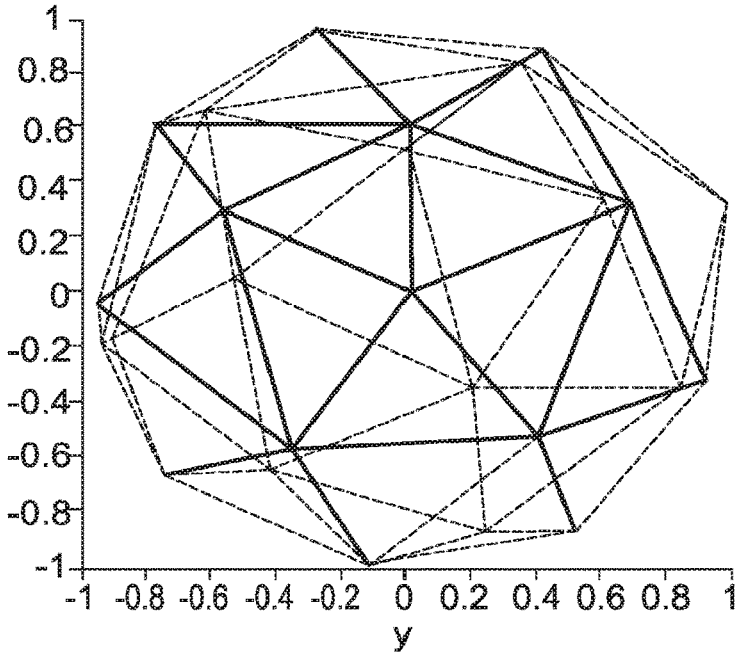

In particular, FIGS. 5A, 5B, 5C, and 5D show examples of spherical sampling positions for a codebook used in encoder and decoder building blocks pE, pD, namely in FIG. 5A for $L_{Sd}=4$, in FIG. 5B for $L_{Sd}=9$, in FIG. 5C for $L_{Sd}=16$ and in FIG. 5D for $L_{Sd}=25$.

In the following, rate compression of Higer Order Ambisonics coefficient data and noise unmasking is described. First, a test signal is defined to highlight some properties, which is used below.

A single far field source located at direction $\Omega_{s_1}$ is represented by a vector $g=[g(m), \ldots, g(M)]^T$ of M discrete time samples and can be represented by a block of HOA coefficients by encoding:

$$B_g=yg^T, \tag{45}$$

with matrix $B_g$ analogous to equation (38) and encoding vector $y=[Y_0^{0*}(\Omega_{s_1}), Y_1^{-1*}(\Omega_{s_1}), \ldots, Y_N^{N*}(\Omega_{s_1})]^T$ composed of conjugate complex Spherical Harmonics evaluated at direction $\Omega_{s_1}=[\theta_{s_1},\phi_{s_1}]^T$ (if real valued SH are used the conjugation has no effect). The test signal $B_g$ can be seen as the simplest case of an HOA signal. More complex signals consist of a superposition of many of such signals.

Concerning direct compression of HOA channels, the following shows why noise unmasking occurs when HOA coefficient channels are compressed. Direct compression and decompression of the $0_{3D}$ coefficient channels of an actual block of HOA data B will introduce coding noise E analogous to equation (4):

$$\hat{B}=B+E. \tag{46}$$

We assume a constant $SNR_{B_g}$ as in equation (9). To replay this signal over loudspeakers the signal needs to be rendered. This process can be described by:

$$\hat{W}=A\hat{B}, \tag{47}$$

with decoding matrix $A\in\mathbb{C}^{L\times O_{3D}}$ (and $A^H=[\alpha_1, \ldots, \alpha_L]$) and matrix $\hat{W}\in\mathbb{C}^{L\times M}$ holding the M time samples of L speaker signals. This is analogous to (14). Applying all considerations described above, the SNR of speaker channel l can be described by (analogous to equation (29)):

$$SNR_{w_l} = SNR_{B_g}\left(1 + \frac{a_l^H \sum_{B,NG} a_l}{a_l^H \operatorname{diag}\left(\sigma_{B_1}^2, \ldots, \sigma_{B_{O_{3D}}}^2\right) a_l}\right), \tag{48}$$

with $\sigma_{B_o}^2$ being the oth diagonal element and $\Sigma_{B,NG}$ holding the non diagonal elements of $$\Sigma_{B=BB^H}. \tag{49}$$

As the decoding matrix A should not be influenced, because it should be possible to decode to arbitrary speaker layouts, the matrix $\Sigma_B$ needs to become diagonal to obtain $SNR_{w_l}=SNR_{B_g}$. With equations (45) and (49), $(B=B_g)$ $\Sigma_B=y g^H g y^H=c\, yy^H$ becomes non diagonal with constant scalar value $c=g^T g$. Compared to $SNR_{B_g}$ the signal to noise ratio at the speaker channels $SNR_{w_l}$ decreases. But since neither the source signal g nor the speaker layout are usually known at the encoding stage, a direct lossy compression of coefficient channels can lead to uncontrollable unmasking effects especially for low data rates.

The following describes why noise unmasking occurs when HOA coefficients are compressed in the spatial domain after using the DSHT.

The current block of HOA coefficient data B is transformed into the spatial domain prior to compression using the Spherical Harmonics Transform as given in equation ():

$$W_{Sd}=\Psi_i B, \tag{50}$$

with inverse transform matrix $\Psi_i$ related to the $L_{Sd}\geq 0_{3D}$ spatial sample positions, and spatial signal matrix $W_{SH}\in\mathbb{C}^{L_{Sd}\times M}$. These are subject to compression and decompression and quantization noise is added (analogous to equation (4)):

$$\hat{W}_{Sd}=W_{Sd}+E, \tag{51}$$

with coding noise component E according to equation (5). Again we assume a SNR, $SNR_{Sd}$ that is constant for all spatial channels. The signal is transformed to the coefficient domain equation (42), using transform matrix $\Psi_f$, which has property (41): $\Psi_f\Psi_i=I$. The new block of coefficients $\hat{B}$ becomes:

$$\hat{B}=\Psi_f\hat{W}_{Sd}. \tag{52}$$

This signals are rendered to L speakers signals $\hat{W}\in\mathbb{C}^{L\times M}$, by applying decoding matrix $A_D$: $\hat{W}=A_D\hat{B}$. This can be rewritten using (52) and $A=A_D\Psi_f$:

$$\hat{W}=A\hat{W}_{Sd}. \tag{53}$$

Here A becomes a mixing matrix with $A\in\mathbb{C}^{L\times L_{Sd}}$. Equation (53) should be seen analogous to equation (14). Again applying all considerations described above, the SNR of speaker channel l can be described by (analogous to equation (29)):

$$SNR_{w_l} = SNR_{s_d}\left(1 + \frac{a_l^H \sum_{W_{Sd},NG} a_l}{a_l^H \operatorname{diag}\left(\sigma_{S_{d_1}}^2, \ldots, \sigma_{S_{d_{L_{Sd}}}}^2\right) a_l}\right), \tag{54}$$

with $$\sigma_{S_{d_l}}^2$$

being the lth diagonal element and $\Sigma_{W_{Sd},NG}$ holding the non diagonal elements of $$\Sigma_{W_{Sd}}=W_{Sd}W_{Sd}^H. \tag{55}$$

Because there is no way to influence $A_D$ (since it should be possible to render to any loudspeaker layout) and thus no way to have any influence on A, $\Sigma_{W_{Sd}}$ needs to become near diagonal to keep the desired SNR: Using the simple test signal from equation (45) ($B=B_g$), $\Sigma_{W_{Sd}}$ becomes $$\Sigma_{W_{Sd}}=c\Psi_i yy^H\Psi_i^H, \tag{56}$$

with $c=g^T g$ constant. Using a fixed Spherical Harmonics Transform ($\Psi_i$, $\Psi_f$ fixed) $\Sigma_{W_{Sd}}$ can only become diagonal in very rare cases and worse, as described above, the term $$\frac{a_l^H \sum_{W_{Sd},NG} a_l}{a_l^H \operatorname{diag}\left(\sigma^2_{S_{d_1}}, \ldots, \sigma^2_{S_{d_{L_{Sd}}}}\right) a_l}$$

depends on the coefficient signals spatial properties. Thus low rate lossy compression of HOA coefficients in the spherical domain can lead to a decrease of SNR and uncontrollable unmasking effects.

A basic idea of the present invention is to minimize noise unmasking effects by using an adaptive DSHT (aDSHT), which is composed of a rotation of the spatial sampling grid of the DSHT related to the spatial properties of the HOA input signal, and the DSHT itself.

A signal adaptive DSHT (aDSHT) with a number of spherical positions $L_{Sd}$ matching the number of HOA coefficients $0_{3D}$, (36), is described below. First, a default spherical sample grid as in the conventional non-adaptive DSHT is selected. For a block of M time samples, the spherical sample grid is rotated such that the logarithm of the term $$\sum_{l=1}^{L_{Sd}} \sum_{j=1}^{L_{Sd}} \left| \sum_{W_{Sd_{l,j}}} \right| - \Sigma\left(\sigma^2_{S_{d_1}}, \ldots, \sigma^2_{S_{d_{L_{Sd}}}}\right) \tag{35}$$

is minimized, where $$\left|\Sigma_{W_{Sd_{l,j}}}\right|$$

are the absolute values of the elements of $\Sigma_{W_{Sd}}$ (with matrix row index l and column index j) and $$\sigma^2_{S_{d_l}}$$

are the diagonal elements of $\Sigma_{W_{Sd}}$. This is equal to minimizing the term $$\frac{a_l^H \sum_{W_{Sd},NG} a_l}{a_l^H \operatorname{diag}\left(\sigma^2_{S_{d_1}}, \ldots, \sigma^2_{S_{d_{L_{Sd}}}}\right) a_l}$$

of equation (54).

Figure 4A:
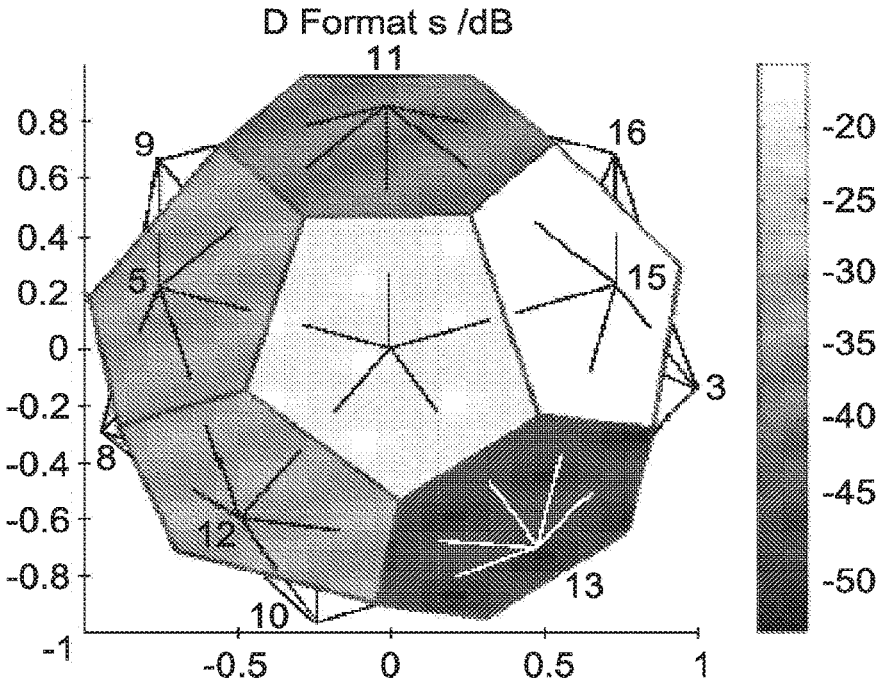
FIGS. 4A and 4B are a test signal.
Figure 4B:
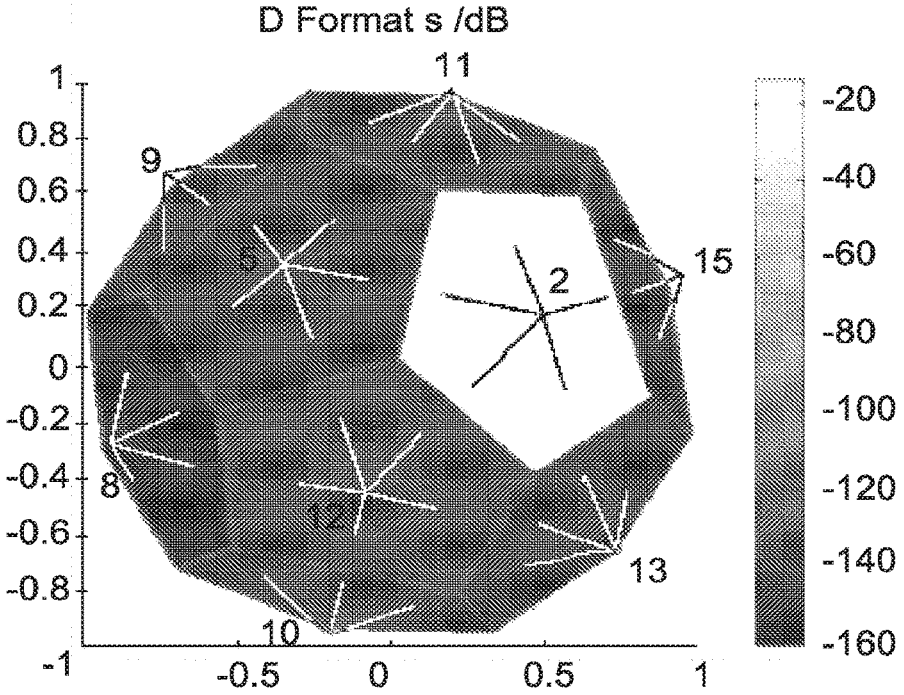

Visualized, this process corresponds to a rotation of the spherical sampling grid of the DSHT in a way that a single spatial sample position matches the strongest source direction, as shown in FIGS. 4A and 4B. Using the simple test signal from equation (45) ($B=B_g$), it can be shown that the term $W_{Sd}$ of equation (55) becomes a vector$\in\mathbb{C}^{L_{Sd}\times 1}$ with all elements close to zero except one. Consequently $\Sigma_{W_{Sd}}$ becomes near diagonal and the desired SNR $SNR_{s_d}$ can be kept.

FIGS. 4A and 4B illustrate a test signal $B_g$ transformed to the spatial domain. In FIG. 4A, the default sampling grid was used, and in FIG. 4B, the rotated grid of the aDSHT was used. Related $\Sigma_{W_{Sd}}$ values (in dB) of the spatial channels are shown by the colors/grey variation of the Voronoi cells around the corresponding sample positions. Each cell of the spatial structure represents a sampling point, and the lightness/darkness of the cell represents a signal strength. As can be seen in FIG. 4B, a strongest source direction was found and the sampling grid was rotated such that one of the sides (i.e. a single spatial sample position) matches the strongest source direction. This side is depicted white (corresponding to strong source direction), while the other sides are dark (corresponding to low source direction). In FIG. 4A, i.e. before rotation, no side matches the strongest source direction, and several sides are more or less grey, which means that an audio signal of considerable (but not maximum) strength is received at the respective sampling point.

The following describes the main building blocks of the aDSHT used within the compression encoder and decoder.

Figure 6:
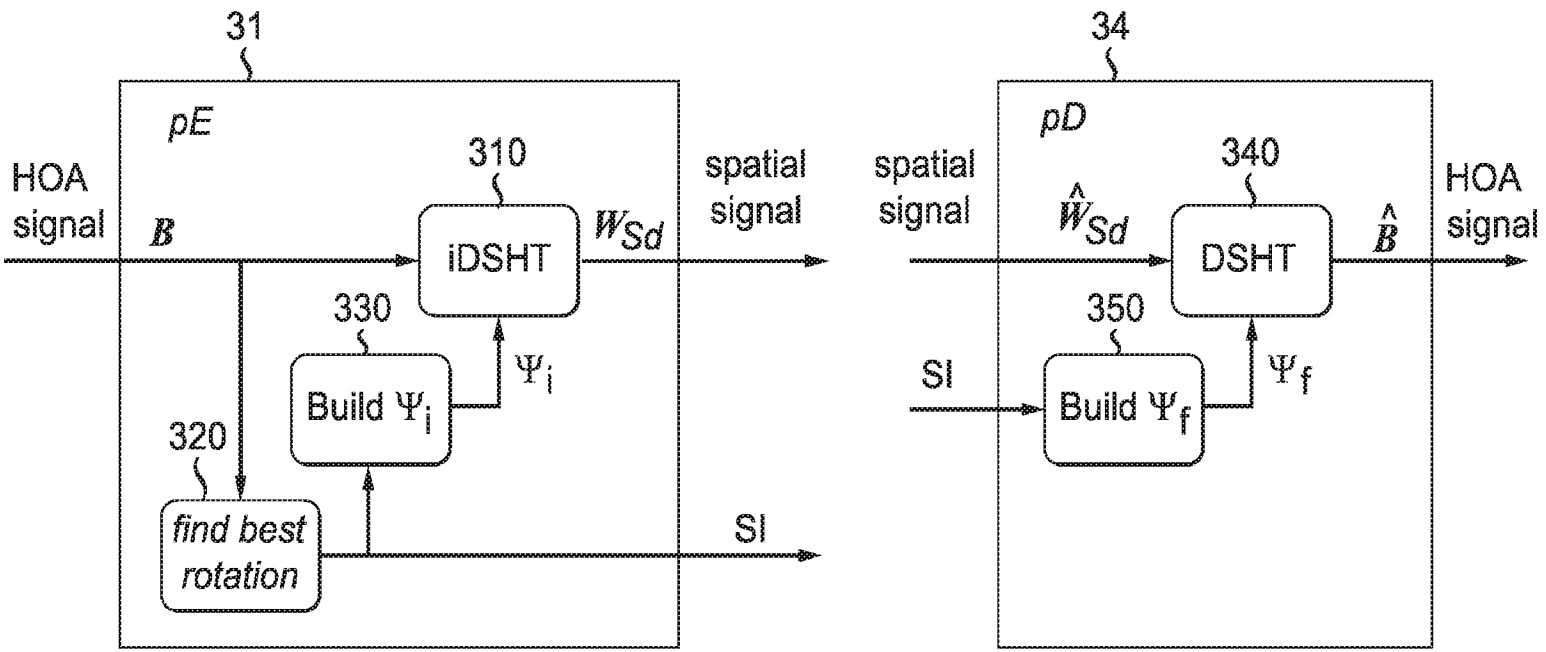
FIG. 6 is a signal adaptive DSHT building blocks (pE and pD)

Details of the encoder and decoder processing building blocks pE and pD are shown in FIG. 6. Both blocks own the same codebook of spherical sampling position grids that are the basis for the DSHT. Initially, the number of coefficients $0_{3D}$ is used to select a basis grid in module pE with $L_{Sd}=0_{3D}$ positions, according to the common codebook. $L_{Sd}$ must be transmitted to block pD for initialization to select the same basis sampling position grid as indicated in FIG. 3. The basis sampling grid is described by matrix $\mathfrak{O}_{DSHT}[\Omega_1, \ldots, \Omega_{L_{Sd}}]$, where $\Omega_l=[\theta_l,\phi_l]^T$ defines a position on the unit sphere. As described above, FIGS. 5A, 5B, 5C, and 5D show examples of basic grids.

Input to the rotation finding block (building block 'find best rotation') 320 is the coefficient matrix B. The building block is responsible to rotate the basis sampling grid such that the value of eq. (57) is minimized. The rotation is represented by the 'axis-angle' representation and compressed axis $\psi_{rot}$ and rotation angle $\varphi_{rot}$ related to this rotation are output to this building block as side information SI. The rotation axis $\psi_{rot}$ can be described by a unit vector from the origin to a position on the unit sphere. In spherical coordinates this can be articulated by two angles: $\psi_{rot}=[\theta_{axis},\phi_{axis}]^T$, with an implicit related radius of one which does not need to be transmitted The three angles $\theta_{axis}$,$\phi_{axis}$, $\varphi_{rot}$ are quantized and entropy coded with a special escape pattern that signals the reuse of previously used values to create side information SI.

The building block 'Build $\Psi_i$' 330 decodes the rotation axis and angle to $\hat{\psi}_{rot}$ and $\hat{\varphi}_{rot}$ and applies this rotation to the basis sampling grid $\mathfrak{O}_{DSHT}$ to derive the rotated grid $\hat{\mathfrak{O}}_{DSHT}=[\hat{\Omega}_1, \ldots, \hat{\Omega}_{L_{sd}}]$. It outputs an iDSHT matrix $\Psi_i=[y_1, \ldots, y_{L_{sd}}]$, which is derived from vectors $y_l=[Y_0^0(\hat{\Omega}_l), Y_1^{-1}(\hat{\Omega}_l), \ldots, Y_N^N(\hat{\Omega}_l)]^T$.

In the building Block 'iDSHT' 310, the actual block of HOA coefficient data B is transformed into the spatial domain by: $W_{Sd}=\Psi_i B$ The building block 'Build $\Psi_f$' 350 of the decoding processing block pD receives and decodes the rotation axis and angle to $\hat{\psi}_{rot}$ and $\hat{\varphi}_{rot}$ and applies this rotation to the basis sampling grid $\mathfrak{O}_{DSHT}$ to derive the rotated grid $\hat{\mathfrak{O}}_{DSHT}=[\hat{\Omega}_1, \ldots, \hat{\Omega}_{L_{sd}}]$. The iDSHT matrix $\Psi_i=[y_1, \ldots, y_{L_{sd}}]$ is derived with vectors $y_l=[Y_0^0(\hat{\Omega}_l), Y_1^{-1}(\hat{\Omega}_l). . . , Y_N^N(\hat{\Omega}_l)]^T$ and the DSHT matrix $\Psi_f=\Psi_i^{-1}$ is calculated on the decoding side.

In the building block 'DSHT' 340 within the decoder processing block 34, the actual block of spatial domain data $\hat{W}_{Sd}$ is transformed back into a block of coefficient domain data: $\hat{B}=\Psi_f\hat{W}_{Sd}$.

In the following, various advantageous embodiments including overall architectures of compression codecs are described. The first embodiment makes use of a single aDSHT. The second embodiment makes use of multiple aDSHTs in spectral bands.

Figure 7:
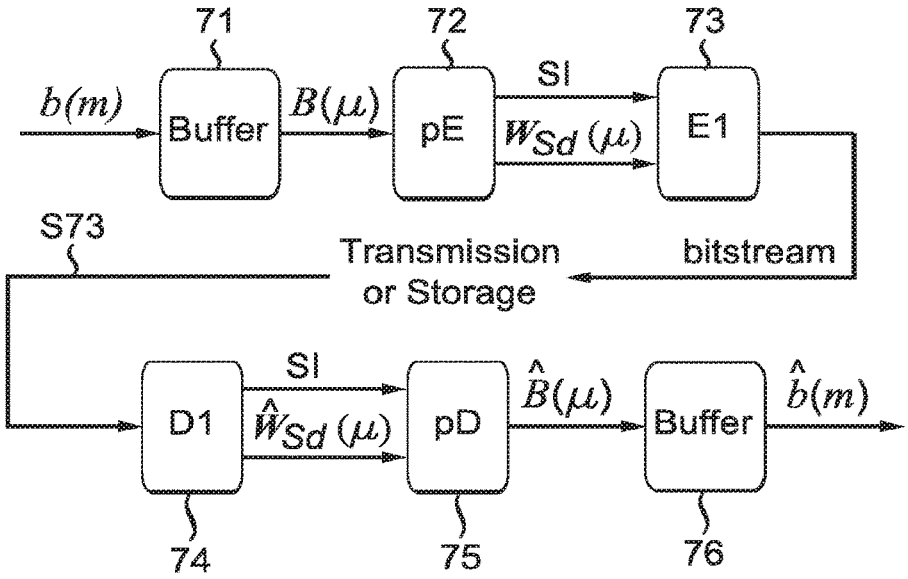
FIG. 7 is a block diagram illustrating an exemplary embodiment of the present invention.

An exemplary embodiment is shown in FIG. 7. The HOA time samples with index m of $0_{3D}$ coefficient channels b(m) are first stored in a buffer 71 to form blocks of M samples and time index μ. B(μ) is transformed to the spatial domain using the adaptive iDSHT in building block pE 72 as described above. The spatial signal block $W_{Sd}(\mu)$ is input to $L_{Sd}$ Audio Compression mono encoders 73, like AAC or mp3 encoders, or a single AAC multichannel encoder ($L_{Sd}$ channels). The bitstream S73 consists of multiplexed frames of multiple encoder bitstream frames with integrated side information SI or a single multichannel bitstream where side information SI is integrated, preferable as auxiliary data.

A respective compression decoder building block comprises, in one embodiment, demultiplexer D1 for demultiplexing the bitstream S73 to $L_{Sd}$ bitstreams and side information SI, and feeding the bitstreams to $L_{Sd}$ mono decoders, decoding them to $L_{Sd}$ spatial Audio channels with M samples to form block $\hat{W}_{Sd}(\mu)$, and feeding $\hat{W}_{Sd}(\mu)$ and SI to pD. In another embodiment, where the bitstream is not multiplexed, a compression decoder building block comprises a receiver 74 for receiving the bitstream and decoding it to a $L_{Sd}$ multichannel signal $\hat{W}_{Sd}(\mu)$, depacking SI and feeding $\hat{W}_{Sd}(\mu)$ and SI to pD.

$\hat{W}_{Sd}(\mu)$ is transformed using the adaptive DSHT with SI in the decoder processing block pD 75 to the coefficient domain to form a block of HOA signals B(μ), which are stored in a buffer 76 to be deframed to form a time signal of coefficients b(m).

The above-described first embodiment may have, under certain conditions, two drawbacks: First, due to changes of spatial signal distribution there can be blocking artifacts from a previous block (i.e. from block μ to μ+1). Second, there can be more than one strong signals at the same time and the de-correlation effects of the aDSHT are quite small.

Both drawbacks are addressed in the second embodiment, which operates in the frequency domain. The aDSHT is applied to scale factor band data, which combine multiple frequency band data. The blocking artifacts are avoided by the overlapping blocks of the Time to Frequency Transform (TFT) with Overlay Add (OLA) processing. An improved signal de-correlation can be achieved by using the invention within J spectral bands at the cost of an increased overhead in data rate to transmit $SI_j$.

Figure 9:
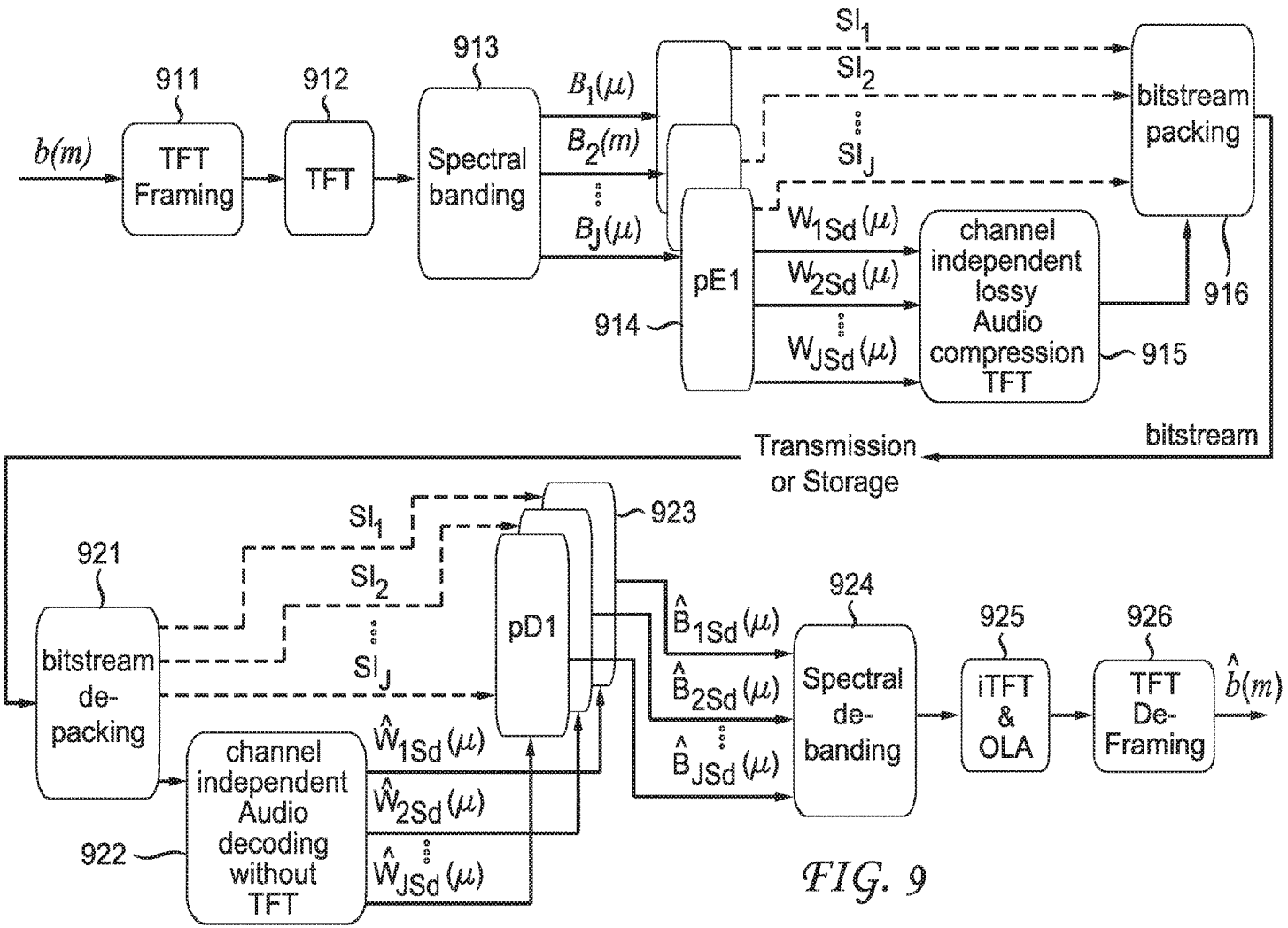
FIG. 9 is a block diagram illustrating another exemplary embodiment of the present invention.

Some more details of the second embodiment, as shown in FIG. 9, are described in the following: Each coefficient channel of the signal b(m) is subject to a Time to Frequency Transform (TFT) 912. An example for a widely used TFT is the Modified Cosine Transform (MDCT). In a TFT Framing unit 911, 50% overlapping data blocks (block index μ) are constructed. A TFT block transform unit 912 performs a block transform. In a Spectral Banding unit 913, the TFT frequency bands are combined to form J new spectral bands and related signals $B_j(\mu)\in\mathbb{C}^{0_{3D}\times K_j}$, where $K_J$ denotes the number of frequency coefficients in band j. These spectral bands are processed in a plurality of processing blocks 914. For each of these spectral bands, there is one processing block $pE_j$ that creates signals $W_{jSd}(\mu)\in\mathbb{C}^{L_{Sd}\times K_j}$ and side information $SI_j$. The spectral bands may match the spectral bands of the lossy audio compression method (like AAC/mp3 scale-factor bands), or have a more coarse granularity. In the latter case, the Channel-independent lossy audio compression without TFT block 915 needs to rearrange the banding. The processing block 914 acts like a $L_{Sd}$ multichannel audio encoder in frequency domain that allocates a constant bitrate to each audio channel. A bitstream is formatted in a bitstream packing block 916.

The decoder receives or stores the bitstream (at least portions thereof), depacks 921 it and feeds the audio data to the multichannel audio decoder 922 for Channel-independent Audio decoding without TFT, and the side information $SI_j$ to a plurality of decoding processing blocks $pD_j$ 923. The audio decoder 922 for channel independent Audio decoding without TFT decodes the audio information and formats the J spectral band signals $\hat{W}_{jSd}(\mu)$ as an input to the decoding processing blocks $pD_j$ 923, where these signals are transformed to the HOA coefficient domain to form $\hat{B}_j(\mu)$. In the Spectral debanding block 924, the J spectral bands are regrouped to match the banding of the TFT. They are transformed to the time domain in the iTFT & OLA block 925, which uses block overlapping Overlay Add (OLA) processing. Finally, the output of the iTFT & OLA block 925 is de-framed in a TFT Deframing block 926 to create the signal $\hat{b}(m)$.

The present invention is based on the finding that the SNR increase results from cross-correlation between channels. The perceptual coders only consider coding noise masking effects that occur within each individual single-channel signals. However, such effects are typically non-linear. Thus, when matrixing such single channels into new signals, noise unmasking is likely to occur. This is the reason why coding noise is normally increased after the matrixing operation.

The invention proposes a decorrelation of the channels by an adaptive Discrete Spherical Harmonics Transform (aDSHT) that minimizes the unwanted noise unmasking effects. The aDSHT is integrated within the compressive coder and decoder architecture. It is adaptive since it includes a rotation operation that adjusts the spatial sampling grid of the DSHT to the spatial properties of the HOA input signal. The aDSHT comprises the adaptive rotation and an actual, conventional DSHT. The actual DSHT is a matrix that can be constructed as described in the prior art. The adaptive rotation is applied to the matrix, which leads to a minimization of inter-channel correlation, and therefore minimization of SNR increase after the matrixing. The rotation axis and angle are found by an automized search operation, not analytically. The rotation axis and angle are encoded and transmitted, in order to enable re-correlation after decoding and before matrixing, wherein inverse adaptive DSHT (iaDSHT) is used.

In one embodiment, Time-to-Frequency Transfrom (TFT) and spectral banding are performed, and the aDSHT/iaDSHT are applied to each spectral band independently.

Figure 8A:
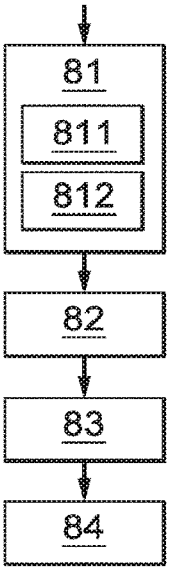
FIGS. 8A and 8B are flow-charts of an encoding process and a decoding process.
Figure 8B:
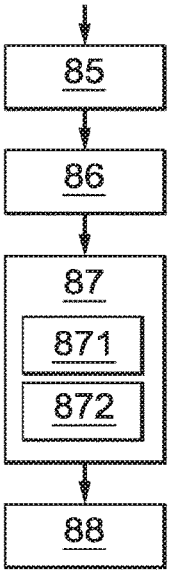

FIG. 8A shows a flow-chart of a method for encoding multi-channel HOA audio signals for noise reduction in one embodiment of the invention. FIG. 8B shows a flow-chart of a method for decoding multi-channel HOA audio signals for noise reduction in one embodiment of the invention.

In an embodiment shown in FIG. 8A, a method for encoding multi-channel HOA audio signals for noise reduction comprises steps of decorrelating 81 the channels using an inverse adaptive DSHT, the inverse adaptive DSHT comprising a rotation operation and an inverse DSHT 812, with the rotation operation rotating 811 the spatial sampling grid of the iDSHT, perceptually encoding 82 each of the decorrelated channels, encoding 83 rotation information (as side information SI), the rotation information comprising parameters defining said rotation operation, and transmitting or storing 84 the perceptually encoded audio channels and the encoded rotation information.

In one embodiment, the inverse adaptive DSHT comprises steps of selecting an initial default spherical sample grid, determining a strongest source direction, and rotating, for a block of M time samples, the spherical sample grid such that a single spatial sample position matches the strongest source direction.

In one embodiment, the spherical sample grid is rotated such that the logarithm of the term $$\sum_{l=1}^{L_{Sd}} \sum_{j=1}^{L_{Sd}} \left| \sum_{W_{Sd_{l,j}}} \right| - \Sigma\left(\sigma^2_{S_{d_1}}, \ldots, \sigma^2_{S_{d_{L_{Sd}}}}\right)$$

is minimized, wherein $$\left| \sum_{W_{Sd_{l,j}}} \right|$$

are the absolute values of the elements of $\Sigma_{W_{Sd}}$ (with matrix row index l and column index j) and $$\sigma^2_{S_{d_l}}$$

are the diagonal elements of $\Sigma_{W_{Sd}}$, where $\Sigma_{W_{Sd}}=W_{Sd}W_{Sd}^H$ and $W_{Sd}$ is a number of audio channels by number of block processing samples matrix, and $W_{Sd}$ is the result of the aDSHT.

In an embodiment shown in FIG. 8B, a method for decoding coded multi-channel HOA audio signals with reduced noise comprises steps of receiving 85 encoded multi-channel HOA audio signals and channel rotation information (within side information SI), decompressing 86 the received data, wherein perceptual decoding is used, spatially decoding 87 each channel using an adaptive DSHT, wherein a DSHT 872 and a rotation 871 of a spatial sampling grid of the DSHT according to said rotation information are performed and wherein the perceptually decoded channels are recorrelated, and matrixing 88 the recorrelated perceptually decoded channels, wherein reproducible audio signals mapped to loudspeaker positions are obtained.

In one embodiment, the adaptive DSHT comprises steps of selecting an initial default spherical sample grid for the adaptive DSHT and rotating, for a block of M time samples, the spherical sample grid according to said rotation information.

In one embodiment, the rotation information is a spatial vector $\hat{\psi}_{rot}$ with three components. Note that the rotation axis $\psi_{rot}$ can be described by a unit vector.

In one embodiment, the rotation information is a vector composed out of 3 angles: $\theta_{axis}$, $\phi_{axis}$, $\varphi_{rot}$, where $\theta_{axis}$, $\phi_{axis}$ define the information for the rotation axis with an implicit radius of one in spherical coordinates, and $\varphi_{rot}$ defines the rotation angle around this axis.

In one embodiment, the angles are quantized and entropy coded with an escape pattern (i.e. dedicated bit pattern) that signals (i.e. indicates) the reuse of previous values for creating side information (SI).

In one embodiment, an apparatus for encoding multi-channel HOA audio signals for noise reduction comprises a decorrelator for decorrelating the channels using an inverse adaptive DSHT, the inverse adaptive DSHT comprising a rotation operation and an inverse DSHT (iDSHT), with the rotation operation rotating the spatial sampling grid of the iDSHT; a perceptual encoder for perceptually encoding each of the decorrelated channels, a side information encoder for encoding rotation information, with the rotation information comprising parameters defining said rotation operation, and an interface for transmitting or storing the perceptually encoded audio channels and the encoded rotation information.

In one embodiment, an apparatus for decoding multi-channel HOA audio signals with reduced noise comprises interface means 330 for receiving encoded multi-channel HOA audio signals and channel rotation information, a decompression module 33 for decompressing the received data by using a perceptual decoder for perceptually decoding each channel, a correlator 34 for re-correlating the perceptually decoded channels, wherein a DSHT and a rotation of a spatial sampling grid of the DSHT according to said rotation information are performed, and a mixer for matrixing the correlated perceptually decoded channels, wherein reproducible audio signals mapped to loudspeaker positions are obtained. In principle, the correlator 34 acts as a spatial decoder.

In one embodiment, an apparatus for decoding multi-channel HOA audio signals with reduced noise comprises interface means 330 for receiving encoded multi-channel HOA audio signals and channel rotation information; decompression module 33 for decompressing the received data with a perceptual decoder for perceptually decoding each channel; a correlator 34 for correlating the perceptually decoded channels using an aDSHT, wherein a DSHT and a rotation of a spatial sampling grid of the DSHT according to said rotation information is performed; and mixer MX for matrixing the correlated perceptually decoded channels, wherein reproducible audio signals mapped to loudspeaker positions are obtained.

In one embodiment, the adaptive DSHT in the apparatus for decoding comprises means for selecting an initial default spherical sample grid for the adaptive DSHT; rotation processing means for rotating, for a block of M time samples, the default spherical sample grid according to said rotation information; and transform processing means for performing the DSHT on the rotated spherical sample grid.

In one embodiment, the correlator 34 in the apparatus for decoding comprises a plurality of spatial decoding units 922 for simultaneously spatially decoding each channel using an adaptive DSHT, further comprising a spectral debanding unit 924 for performing spectral debanding, and an iTFT&OLA unit 925 for performing an inverse Time to Frequency Transform with Overlay Add processing, wherein the spectral debanding unit provides its output to the iTFT&OLA unit.

In all embodiments, the term reduced noise relates at least to an avoidance of coding noise unmasking.

Perceptual coding of audio signals means a coding that is adapted to the human perception of audio. It should be noted that when perceptually coding the audio signals, a quantization is usually performed not on the broadband audio signal samples, but rather in individual frequency bands related to the human perception. Hence, the ratio between the signal power and the quantization noise may vary between the individual frequency bands. Thus, perceptual coding usually comprises reduction of redundancy and/or irrelevancy information, while spatial coding usually relates to a spatial relation among the channels.

The technology described above can be seen as an alternative to a decorrelation that uses the Karhunen-Loeve-Transformation (KLT). One advantage of the present invention is a strong reduction of the amount of side information, which comprises just three angles. The KLT requires the coefficients of a block correlation matrix as side information, and thus considerably more data. Further, the technology disclosed herein allows tweaking (or fine-tuning) the rotation in order to reduce transition artifacts when proceeding to the next processing block. This is beneficial for the compression quality of subsequent perceptual coding.

Tab.1 provides a direct comparison between the aDSHT and the KLT. Although some similarities exist, the aDSHT provides significant advantages over the KLT.

While there has been shown, described, and pointed out fundamental novel features of the present invention as applied to preferred embodiments thereof, it will be understood that various omissions and substitutions and changes in the apparatus and method described, in the form and details of the devices disclosed, and in their operation, may be made by those skilled in the art without departing from the spirit of the present invention. It is expressly intended that all combinations of those elements that perform substantially the same function in substantially the same way to achieve the same results are within the scope of the invention. Substitutions of elements from one described embodiment to another are also fully intended and contemplated.

It will be understood that the present invention has been described purely by way of example, and modifications of detail can be made without departing from the scope of the invention.

Each feature disclosed in the description and drawings may be provided independently or in any appropriate combination. Features may, where appropriate be implemented in hardware, software, or a combination of the two. Connections may, where applicable, be implemented as wireless connections or wired, not necessarily direct or dedicated, connections.

TABLE 1

Comparison of aDSHT vs. KLT

| | sDSHT | KLT |
|---|---|---|
| Definition | B is a N order HOA signal matrix $(N+1)^2$ rows (coefficients), T columns (time samples); W is a spatial matrix with $(N+1)^2$ rows (channels), T columns (times samples) | |
| Encoder, spatial transform | Inverse aDSHT<br>$W^{Sd} = \Psi^i B$ | Karhunen Loève transform<br>$W^k = K B$ |
| Transform Matrix | A spherical regular sampling grid with $(N+1)^2$ spherical sample positions known to encoder and decpder is selected. This grid is rotated around axis $\psi_{rot}$ and rotation angle $\psi_{rot}$, which have been derived before (see remark below). A Mode-matrix $\Psi_f$ of that grid is created (i.e. spherical harmonics of these positions): $\Psi_i = \Psi_f^{-1}$<br>(Or more general $\Psi_i + \Psi_f$ with $\Psi_f \Psi_i = I$ when the number of spatial channels becomes bigger then $(N+1)^2$ )<br>The transform matrix is the inverse mode matrix of a rotated spherical grid. The rotation is signal driven and updated every processing block | Build covariance matrix:<br>$C = BB^H$<br>Eigenwert decomposition:<br>$C = K^H \Lambda K$,<br>with Eigen values diagonal in $\Lambda$ and related Eigen vectors arranged in $K^H$ with $KK^H = 1$ line in any orthogonal transform.<br>The transform matrix is derived from the signal B for every processing block. |
| Side Info to transmit | axis $\psi_{rot}$ and rotation angle $\psi_{rot}$ for example coded as 3 values: $\theta_{axis}$, $\phi_{axis}$, $\varphi_{rot}$ | More than half of the elements C (that is, $\frac{(N+1)^4 + (N+1)^2}{2}$ values) or K (that is, $(N+1)^4$ values) |
| Lossy decompressed spatial signal | The spatial signals are lossy coded, (coding noise $E_{cod}$). A block of T samples is arranges as $\hat{W}_{Sd}$ | The spatial signals are lossy coded (coding noise $\hat{E}_{cod}$). A block of T samples is arranges as $\hat{W}_k$ |
| Decoder, inverse spatial transform | $\hat{B} = \Psi_f \hat{W}_{Sd} = B + \Psi_f E_{cod}$ | $\hat{B}_k = K\hat{W}_k = B + K\hat{E}_{cod}$ |
| Remark | In one embodiment, the grid is rotated such that a sampling position matches the strongest signal direction within B. An analysis of the covariance matrix can be used here, like it is usable for the KLT. In practive, since more simple and less computationally complex, signal tracking models can be used that also allow to adapt/modify the rotations smoothly from blobk to blobk, which avoids creation of blocking artifacts within the lossy (perceptual) coding blocks | |

CITED REFERENCES

[1] T. D. Abhayapala. Generalized framework for spherical microphone arrays: Spatial and frequency decomposition. In Proc. IEEE International Conference on Acoustics, Speech, and Signal Processing (ICASSP), (accepted) Vol. X, pp., April 2008, Las Vegas, USA.

[2] James R. Driscoll and Dennis M. Healy Jr. Computing fourier transforms and convolutions on the 2-sphere. Advances in Applied Mathematics, 15:202-250, 1994.

[3] Jörg Fliege. Integration nodes for the sphere, http://www.personal.soton.ac.uk/jf1w07/nodes/nodes.html

[4] Jörg Fliege and Ulrike Maier. A two-stage approach for computing cubature formulae for the sphere. Technical Report, Fachbereich Mathematik, Universität Dortmund, 1999.

[5] R. H. Hardin and N. J. A. Sloane. Webpage: Spherical designs, spherical t-designs. http://www2.research.att.com/~njas/sphdesigns

[6] R. H. Hardin and N. J. A. Sloane. Mclaren's improved snub cube and other new spherical designs in three dimensions. Discrete and Computational Geometry, 15:429-441, 1996.

[7] Erik Hellerud, Ian Burnett, Audun Solvang, and U. Peter Svensson. Encoding higher order Ambisonics with AAC. In 124th AES Convention, Amsterdam, May 2008.

[8] Peter Jax, Jan-Mark Batke, Johannes Boehm, and Sven Kordon. Perceptual coding of HOA signals in spatial domain. European patent application EP2469741A1 (PD100051).

[9] Boaz Rafaely. Plane-wave decomposition of the sound field on a sphere by spherical convolution. J. Acoust. Soc. Am., 4(116):2149-2157, October 2004.

[10] Earl G. Williams. Fourier Acoustics, volume 93 of Applied Mathematical Sciences. Academic Press, 1999.

The invention claimed is:

1. A method for decoding Higher Order Ambisonics (HOA) audio signals, the method comprising:

decompressing the HOA audio signals based on perceptual decoding to determine at least an HOA representation corresponding to the HOA audio signals;

determining a rotated transform based on a rotation of a spherical sample grid; and determining a rotated HOA representation based on the rotated transform and the HOA representation.

2. An apparatus for decoding Higher Order Ambisonics (HOA) audio signals, the apparatus comprising:

a decoder configured to:

decompress the HOA audio signals based on perceptual decoding to determine HOA representations corresponding to the HOA audio signals;

determine a rotated transform based on a rotation of a spherical sample grid; and determine a rotated HOA representation based on the rotated transform and the HOA representation.

3. A non-transitory computer readable medium containing instructions that when executed by a processor perform the method of claim 1.

* * * * *